US008833513B2

(12) United States Patent
Matsumoto

(10) Patent No.: US 8,833,513 B2
(45) Date of Patent: Sep. 16, 2014

(54) EXHAUST MUFFLER PROVIDED WITH TAIL PIPE

(75) Inventor: Noboru Matsumoto, Yashio (JP)

(73) Assignee: Matsushou Co., Ltd., Yashio-shi, Saitama (JP)

( * ) Notice: Subject to any disclaimer, the term of this patent is extended or adjusted under 35 U.S.C. 154(b) by 55 days.

(21) Appl. No.: 13/823,359

(22) PCT Filed: Sep. 7, 2011

(86) PCT No.: PCT/JP2011/070323
§ 371 (c)(1),
(2), (4) Date: Mar. 14, 2013

(87) PCT Pub. No.: WO2012/036032
PCT Pub. Date: Mar. 22, 2012

(65) Prior Publication Data

US 2013/0168182 A1 Jul. 4, 2013

(30) Foreign Application Priority Data

Sep. 17, 2010 (JP) ..... 2010-209345

(51) Int. Cl.

| | |
|---|---|
| ***F01N 13/08*** | (2010.01) |
| ***F01N 13/02*** | (2010.01) |
| ***F01N 1/12*** | (2006.01) |
| *F01N 13/00* | (2010.01) |
| *F01N 1/02* | (2006.01) |

(52) U.S. Cl.
USPC ..... 181/228; 181/227; 181/232; 181/249; 181/255

(58) Field of Classification Search
USPC ..... 181/228, 227, 231, 232, 249, 251, 255, 181/270, 274, 279, 280
See application file for complete search history.

(56) References Cited

U.S. PATENT DOCUMENTS 1,038,931 A * 9/1912 Michaelson ..... 181/228
1,377,472 A * 5/1921 Hamilton ..... 181/263
(Continued)

FOREIGN PATENT DOCUMENTS

JP 53-23835 2/1978
JP 56-143310 11/1981
(Continued)

OTHER PUBLICATIONS

International Search Report issued in International Patent Application No. PCT/JP2011/070323; Nov. 15, 2011; 2 pages; Japanese Patent Office.

*Primary Examiner* — Edgardo San Martin
(74) *Attorney, Agent, or Firm* — Wood, Herron & Evans, LLP

(57) ABSTRACT

An exhaust muffler with a tail pipe for suppressing ripples, increasing an engine output and improving fuel consumption efficiency is provided. A chamber is provided in the middle of an exhaust pipe for an internal combustion engine. A tail pipe connected to an end portion of an exhaust opening of the exhaust pipe is provided. A plurality of fins are disposed inside the tail pipe in a spiral shape that is gradually widened toward a discharging direction of the exhaust gas. The chamber includes a cover body and an internal exhaust pipe surrounded by the cover body. The internal exhaust pipe includes a diffusion exhaust pipe having a wide bore and a compression exhaust pipe having a narrow bore. Diffusion pores are drilled on a portion of the side surface of the internal exhaust pipe.

2 Claims, 8 Drawing Sheets

(56) References Cited

U.S. PATENT DOCUMENTS

| | | | | | |
|---|---|---|---|---|---|
| 1,521,074 | A | * | 12/1924 | Carr | 181/227 |
| 2,112,534 | A | * | 3/1938 | Keen | 239/418 |
| 2,548,472 | A | * | 4/1951 | Gibson | 417/542 |
| 3,578,107 | A | * | 5/1971 | Everett et al. | 181/232 |
| 3,645,357 | A | * | 2/1972 | Cassel | 181/227 |
| 3,648,802 | A | * | 3/1972 | Pierce | 181/227 |
| 4,671,381 | A | * | 6/1987 | Rascov | 181/255 |
| 4,792,014 | A | * | 12/1988 | Shin-Seng | 181/280 |
| 5,058,704 | A | * | 10/1991 | Yu | 181/262 |
| 5,574,264 | A | * | 11/1996 | Takemori et al. | 181/206 |
| 6,105,717 | A | * | 8/2000 | Kleukers | 181/282 |
| 6,283,162 | B1 | * | 9/2001 | Butler | 138/177 |
| 6,360,782 | B1 | * | 3/2002 | Yoshitoshi et al. | 138/115 |
| 6,588,545 | B1 | * | 7/2003 | Lee | 181/264 |
| 6,688,425 | B2 | * | 2/2004 | Cole et al. | 181/264 |
| 7,086,497 | B2 | * | 8/2006 | Cole et al. | 181/248 |
| 7,252,177 | B2 | * | 8/2007 | Minato | 181/240 |
| 2005/0205355 | A1 | * | 9/2005 | Lin | 181/279 |
| 2007/0289809 | A1 | * | 12/2007 | Kim | 181/227 |

FOREIGN PATENT DOCUMENTS

| | | | | | |
|---|---|---|---|---|---|
| JP | 05026025 | A | * | 2/1993 | F01N 1/08 |
| JP | 7-30705 | | | 4/1995 | |
| JP | 2741355 | | | 4/1998 | |
| JP | 2007-205347 | | | 8/2007 | |
| JP | 4174789 | | | 11/2008 | |
| JP | 3153112 | | | 8/2009 | |
| JP | 2010223043 | A | * | 10/2010 | |
| JP | 2012062881 | A | * | 3/2012 | |
| WO | WO 2010110025 | A1 | * | 9/2010 | F01N 13/08 |

* cited by examiner

EXHAUST MUFFLER PROVIDED WITH TAIL PIPE

TECHNICAL FIELD

The present invention relates to an exhaust muffler provided with a tail pipe which can increase fuel efficiency of the vehicle by combining an improved chamber and a tail pipe installed on an end portion of a muffler.

BACKGROUND ART

Usually, in four-stroke cycle engine, a series movement such as intake-compression-explosion-exhaust is repeated inside a cylinder by a reciprocating motion of a piston. At this time, an intake valve and an exhaust valve, that open and close in synchronization with the movement of the piston, are provided on the cylinder. Then, high-pressure exhaust gas after the explosion is finished is pushed to an exhaust pipe from the exhaust valve with explosion sound. When such a piston movement is repeated, exhaust ripples are generated periodically by the exhaust gas inside the exhaust pipe. Then, the high-pressure exhaust gas with the exhaust ripples is muted inside a chamber (a silencer) provided in the middle of the exhaust pipe.

Originally, the chamber (Expansion Chamber) is an expansion chamber provided on the exhaust pipe in order to enhance a charging efficiency of an air-fuel mixture, mainly in an exhaust muffler of a two-stroke cycle engine. Then, when the exhaust gas reaches the chamber, the exhaust gas is expanded vigorously in the chamber. A shock wave generated when the expansion is generated is reflected inside the chamber and the air-fuel mixture drawn into the exhaust pipe is pushed back into the cylinder. The air-fuel mixture, which is greater than the volume of the cylinder is compressed and filled by using the effect in a timely manner. As a result, the same effect as an increase of the displacement can be obtained.

Generally, in the exhaust muffler in a four-cycle engine, the chamber is used as the silencer and in the four-cycle engine similar to the chamber of the two-cycle engine, there is an energy-saving exhaust muffler including effect to control the flow of the exhaust gas on the exhaust pipe side and to push back a burned gas blown into the exhaust pipe side to the cylinder.

In other words, for the purpose of controlling the exhaust ripples, there is an energy-saving exhaust muffler which has a pipe having a different thickness or a room (a chamber) having an expanded volume provided in the middle of the exhaust pipe. In the energy-saving exhaust muffler, a technique is known in which the shock wave generated inside the chamber is reflected in a direction of the exhaust valve of the cylinder and the unburned gas is adjusted to push back efficiently to the cylinder so that the engine efficiency or the fuel efficiency can be improved.

As the energy-saving exhaust muffler in the related art, an exhaust device for the internal combustion engine to improve the engine efficiency by assisting a combustion action of the engine is disclosed in Patent Document 1. According to the exhaust muffler, the exhaust gas is sucked from the engine, and is compressed and expanded in a multistage to keep the muffler quiet, and at the same time, the exhaust gas is accelerated and drained in a spiral shape thereby assisting the combustion action of the internal combustion engine. Accordingly, the efficiency thereof is improved.

Thus, in Patent Document 1, the exhaust gas is sucked and accelerated and then a back pressure that is a load of the engine is decreased by disposing a straight-shaped internal pipe inside the chamber of the muffler and by providing a spiral plate (a fin) on an outer periphery of the internal pipe thereof Accordingly, an amount of the fuel consumption is reduced.

In addition, a low-speed torque generation device for the internal combustion engine is disclosed in Patent Document 2. In the device, a movable valve body that moves in response to the flow amount of the exhaust gas is provided inside the exhaust muffler and the movable valve body is moved thereby adjusting the amount of the exhaust gas. In other words, a state of applying the load on the engine is set up inside the exhaust muffler and a torque is generated to increase the output of the engine.

In addition, the applicant of the present invention has developed a silencer for the internal combustion engine to reduce noise of the exhaust gas (Patent Document 3), a muffler cutter to improve the exhaust efficiency (Patent Document 4) or the like, and has left a number of research results for improving the performance of the exhaust muffler.

In the configuration of the silencer disclosed in Patent Document 3, an exhaust pipe is provided inside a cylindrical resonance chamber and a screw-shaped guide plate is disposed inside the exhaust pipe. Accordingly, the exhaust muffler is configured such that a portion of the exhaust gas entered along the guide plate is transported to the resonance chamber. As a result, effect to increase the exhaust efficiency of the internal combustion engine is obtained together with a high silence effect.

In addition, the muffler cutter disclosed in Patent Document 4 is installed on an end portion of the exhaust muffler and the exhaust efficiency is increased. In the configuration, a double cylinder having an external cylinder and an internal cylinder is formed, and a center cylinder is disposed inside the internal cylinder. Then, a plurality of fin lines are provided between an outer surface of the center cylinder and an inner surface of the internal cylinder. According to the configuration, the exhaust gas is guided by the fins and disposed while rotating in a spiral shape and the loss of the output of the engine is reduced by increasing the exhaust efficiency.

PRIOR ART DOCUMENTS

Patent Documents

[Patent Document 1] Japanese Unexamined Utility Model Application, First Publication No. S53-23835

[Patent Document 2] Japanese Examined Patent Application, Second Publication No. H7-30705

[Patent Document 3] Japanese Patent Publication No. 2741355

[Patent Document 4] Japanese Patent Publication No. 4174789

DISCLOSURE OF INVENTION

Problems to be Solved by the Invention

In the exhaust muffler of the related art, since the volume of the high-pressure exhaust gas is expanded at once to the atmosphere even when the exhaust gas is discharged from an outlet of the exhaust muffler to the atmosphere, new ripples are generated. The ripples are minute compared to the exhaust ripples inside the chamber; however, the ripples are very nuisance specifically, in the exhaust muffler of a type in which the engine efficiency is improved by efficiently using the shock wave such as an energy-saving type exhaust muffler.

In other words, if the ripples are generated when the exhaust gas is discharged from the outlet of the exhaust muffler to the atmosphere, the ripples are transmitted to the exhaust muffler and the ripples adversely affect the rhythm of the shock wave which is reflected inside the chamber. Then, the shock wave interferes effective timing when unburned gas is pushed into the cylinder. In addition, it is difficult to improve the engine efficiency or the fuel efficiency in the energy-saving exhaust muffler.

Accordingly, the influence of the ripples cannot be avoided even in the exhaust device disclosed in Patent Document 1 or in the exhaust muffler of the torque generation device in Patent Document 2. Thus, according to the design without considering the ripples, even though energy-saving effects can be expected in the design step, the effect in the design step cannot be expected when the muffler is run practically. Specific data indicating the fuel efficiency, the power or the torque is not disclosed in Patent Document 1 and Patent Document 2, and it is not clear how much effect is realized.

On the other hand, the inventor of the present invention arrived at a position that it is most effective to consider balance between the chamber portion of the exhaust muffler and the tail pipe portion (the muffler cutter) mounted on the exhaust opening based on research and a very large number of tests until now, in order to realize energy-saving exhaust muffler by suppressing the ripples.

Then, the present invention is made to solve the problems described above and an object of the present invention is to provide an energy-saving exhaust muffler provided with a tail pipe in which the ripples, which are generated when the exhaust gas is discharged from an outlet of an exhaust muffler to the atmosphere, is suppressed, a shock wave inside a chamber does not interfere that unburned gas is pushed into a cylinder and increase in the output of the engine or improvement effect of the fuel consumption can be achieved.

Means for Solving the Problems

First means for achieving the above object in the present invention includes: a chamber 10 provided in the middle of an exhaust pipe 1 for an internal combustion engine; and a tail pipe 20 which is connected to an end portion of an exhaust opening of the exhaust pipe 1 and in which a plurality of fins 21 are disposed inside thereof in a spiral shape gradually widening toward a discharging direction of exhaust gas, wherein the chamber 10 is configured of a cover body 11 surrounding a periphery of a side surface of the exhaust pipe 1 and an internal exhaust pipe 12 in which a plurality of diffusion pores 15 are drilled on the side surface of the exhaust pipe 1 surrounded by the cover body 11, and wherein the internal exhaust pipe 12 is configured of a diffusion exhaust pipe 13 having a wide bore, which is provided on an inlet side of the exhaust gas, and a compression exhaust pipe 14 having a narrow bore, which is provided on an outlet side of the exhaust gas, and wherein the diffusion pores 15 are drilled on a portion of the side surface of the internal exhaust pipe 12.

According to second means, in the chamber 10, the diffusion exhaust pipe 13 and the compression exhaust pipe 14 are connected in series with each other, and a partition plate 16 bisecting the inside of the diffusion exhaust pipe 13 in the longitudinal direction and the compression exhaust pipe 14 is formed, and the diffusion pores 15 are drilled so as to be distributed on symmetrical positions through the partition plate 16 of the peripheral surface of the diffusion exhaust pipe 13.

According to third means, the chamber 10 is configured such that the diffusion exhaust pipe 13 and the compression exhaust pipe 14 are connected in parallel with each other inside the cover body 11, and the diffusion pores 15 are drilled on the side surface in the farthest positions between the diffusion exhaust pipe 13 and the compression exhaust pipe 14.

According to fourth means, the tail pipe 20 is formed in a cylindrical shape having the same diameter extending from the end portion of the exhaust pipe 1 in the discharging direction of the exhaust gas or a taper shape having a diameter which is widened as extending in the discharging direction of the exhaust gas, or a reverse taper shape having a diameter which is narrowed as extending in the discharging direction of the exhaust gas.

According to fifth means, that the diffusion pores 15 are drilled in a range of 30 to 60% of the periphery of the internal exhaust pipe 12 is means to solve the problems.

Effects of the Invention

The exhaust muffler provided with a tail pipe includes the chamber 10 provided in the middle of the exhaust pipe 1 for the internal combustion engine; and the tail pipe 20 which is connected to the end portion of the exhaust opening of the exhaust pipe 1 and in which the plurality of fins 21 are disposed inside thereof in the spiral shape gradually widening toward the discharging direction of exhaust gas. The diffusion pores 15 are drilled on a portion of the side surface of the compression exhaust pipe 14. Accordingly, the ripples generated when the exhaust gas is discharged from the outlet of the exhaust muffler to the atmosphere are suppressed and a problem that the shock wave inside the chamber interferes with the effective timing when the unburned gas is pushed into the cylinder can be avoided. As a result, the power value and the torque value in the internal combustion engine can be increased, and high improvement effect of the fuel consumption is obtained.

Specifically, the power value and the torque value in a reciprocating-type engine can be increased, and improvement effect of the fuel consumption is obtained by the chamber 10 in which the diffusion exhaust pipe 13 and the compression exhaust pipe 14 are connected in series with each other.

Specifically, the power value and the torque value in a hybrid-type engine can be increased, and high improvement effect of the fuel consumption is obtained by the chamber 10 in which the diffusion exhaust pipe 13 and the compression exhaust pipe 14 are connected in parallel with each other inside the exhaust pipe 1.

The tail pipe 20 is the tail pipe 20 which is disposed inside thereof in the spiral shape in which the plurality of the fins 21 are gradually widened toward the discharging direction of the exhaust gas. The tail pipe 20 may be selected from any one of the cylindrical shape having the same diameter extending from the end portion of the exhaust pipe 1 in the discharging direction of the exhaust gas, the taper shape having a diameter which is widened as extending in the discharging direction of the exhaust gas or the reverse taper shape having a diameter which is narrowed as extending in the discharging direction of the exhaust gas. Furthermore, the exhaust muffler, in which the fuel consumption characteristics, the power value characteristics and the torque value characteristics are different, can be provided by the shapes of the tail pipe 20. Accordingly, the exhaust muffler can be provided by appropriately selecting the shape of the tail pipe 20 according to the characteristics of the engine, depending on the displacement or type of the engine.

Then, when the diffusion pores 15 are drilled in a range of 30 to 60% of the periphery of the internal exhaust pipe 12, the greatest improvement of the fuel consumption is achieved.

EMBODIMENTS FOR CARRYING OUT THE INVENTION

According to the present invention, an energy-saving type exhaust muffler provided with the tail pipe is realized in which the ripples, which are generated when the exhaust gas is discharged from an outlet of an exhaust muffler to the atmosphere, is suppressed, a shock wave inside a chamber does not interfere that unburned gas is pushed into a cylinder by the energy-saving type exhaust muffler, and increase in the output of the engine or improvement effect of the fuel consumption can be achieved.

Hereinafter, the present invention is described, based on examples illustrated the drawings. Specifically, the exhaust muffler 2 in the present invention is an exhaust muffler in which ripples are suppressed and the shock wave is effectively used when the exhaust gas is discharged.

Figure 1:
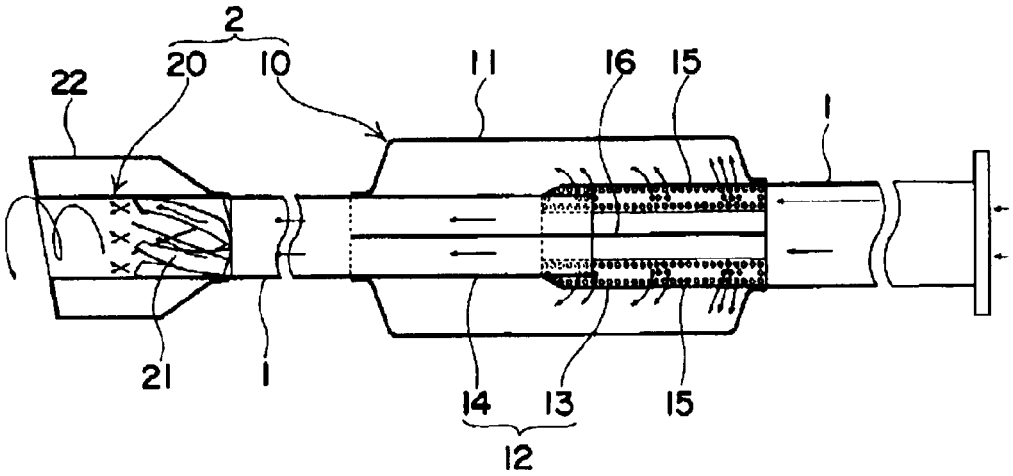
FIG. 1 is a side cross-sectional view illustrating a first embodiment of a muffler of the present invention.
Figure 4:
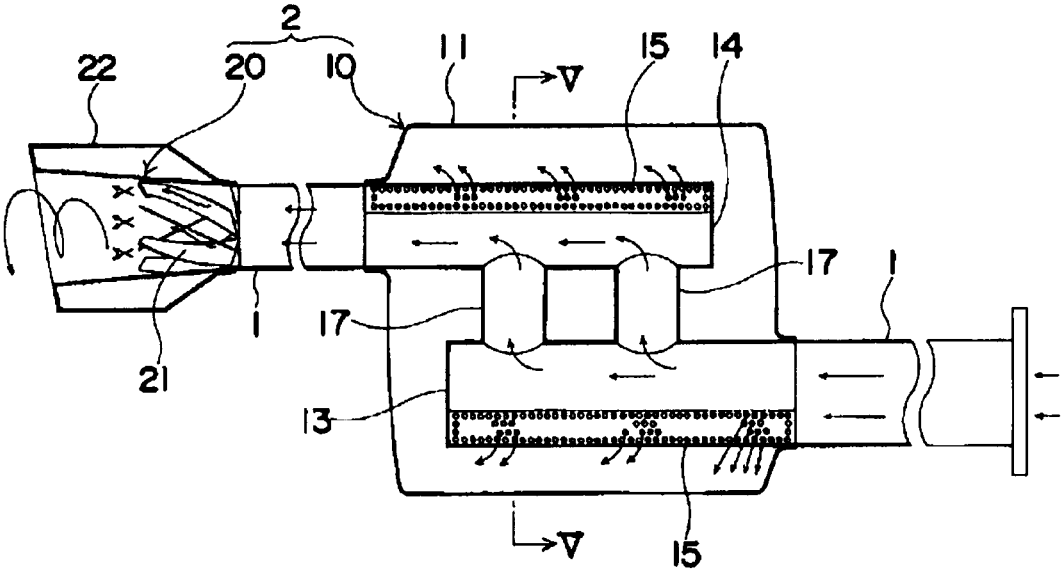
FIG. 4 is a side cross-sectional view illustrating a second embodiment of the muffler of the present invention.

The present invention is configured of the chamber 10 and the tail pipe 20 (see, FIGS. 1 and 4). The chamber 10 is provided in the middle of the exhaust pipe 1 for the internal combustion engine and the tail pipe 20 is connected to the end portion of the exhaust opening of the exhaust pipe 1.

The chamber 10 is configured of the cover body 11, the internal exhaust pipe 12 and the diffusion exhaust pipe 13. The cover body 11 is formed in a substantially cylindrical shape to surround a periphery of a side surface of the exhaust pipe 1 and is a member forming a diffusion space between the exhaust pipe 1 and the cover body 11.

The internal exhaust pipe 12 is the internal exhaust pipe 12 that is the exhaust pipe 1 surrounded by the cover body 11 and is configured of the diffusion exhaust pipe 13 and the compression exhaust pipe 14. Then, the diffusion pores 15 are drilled on a portion of a side surface of the internal exhaust pipe 12.

The diffusion exhaust pipe 13 is the internal exhaust pipe 12, which is provided on an inlet side of the exhaust gas and has a wide bore. In addition, the compression exhaust pipe 14 is the internal exhaust pipe 12, which is provided on an outlet side of the exhaust gas and has a narrow bore. The diffusion pore 15 is provided on side surfaces (see, FIG. 1) facing each other of the compression exhaust pipe 14 or are provided on side surfaces (see, FIG. 4) which are in the farthest positions between the compression exhaust pipe 14 and the diffusion pores 15 each other. In a test, a range of the diffusion pore 15 is not the entire surface of the peripheral surface of the internal exhaust pipe 12 but is 30 to 60% of the periphery of the internal exhaust pipe 12. In addition, it is verified that the fuel consumption effect can be increased when the position of the diffusion pore 15 is, for example, drilled in a state of being distributed to separate in the farthest two positions from each other. The farthest positions may be, for example, the side surfaces facing each other on the peripheral surface of the diffusion exhaust pipe 13 or the side surfaces in the farthest positions of the internal exhaust pipe 12 in parallel with each other (see, FIGS. 2 and 5).

Figure 10:
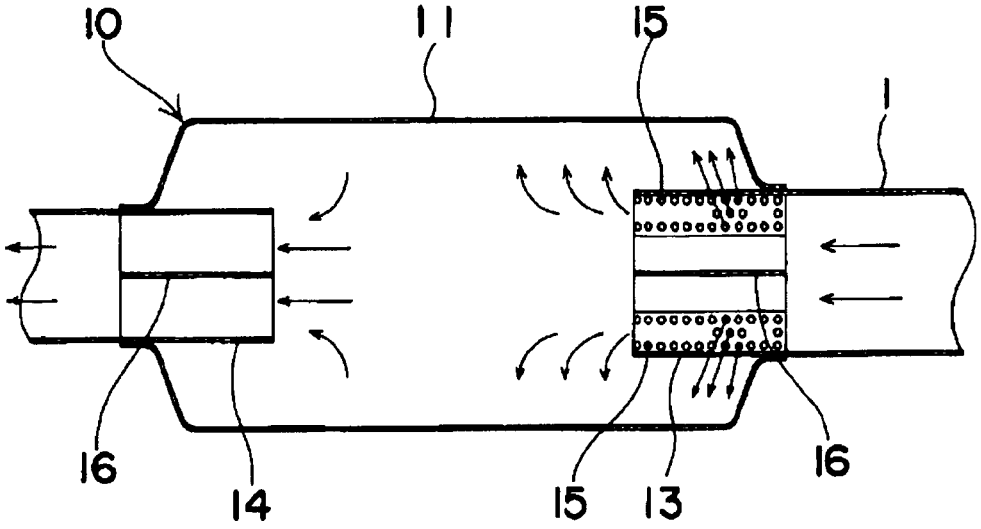
FIG. 10 is a side cross-sectional view illustrating another embodiment of a chamber of the present invention.
Figure 11:
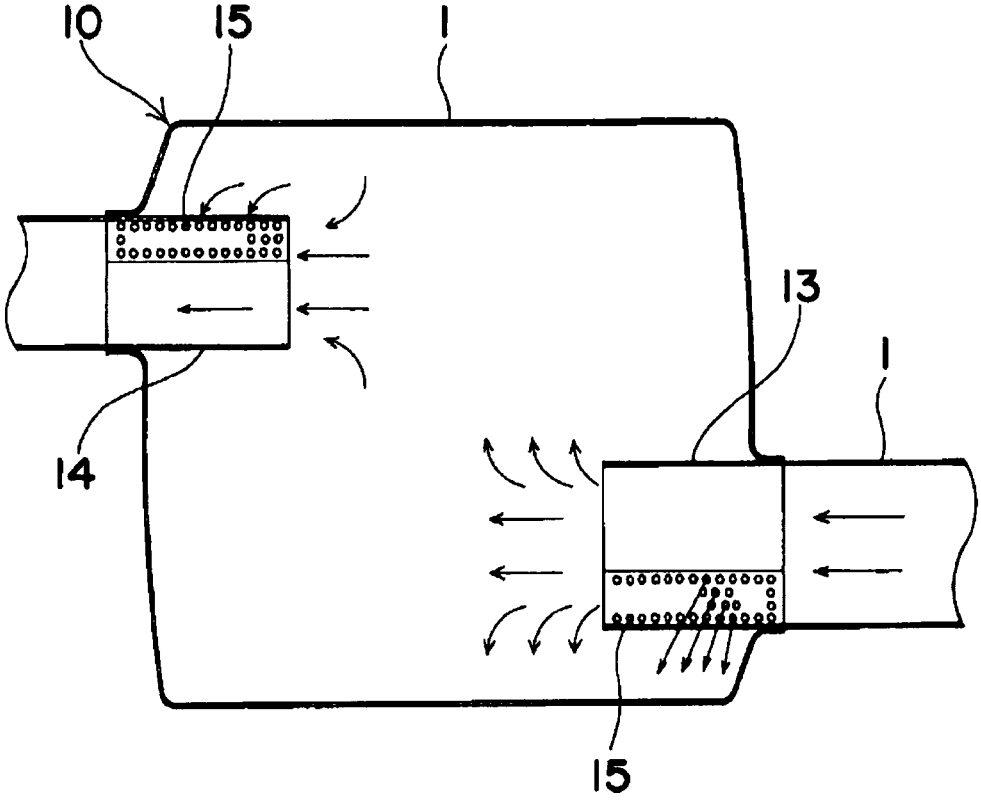
FIG. 11 is a side cross-sectional view illustrating another embodiment of the chamber of the present invention.

The diffusion exhaust pipe 13 and the compression exhaust pipe 14 are connected in series with each other inside the cover body 11 (see, FIG. 1). In addition, they may be connected in parallel with each other via the connection pipe 17 (see, FIG. 4). Furthermore, as illustrated in FIGS. 10 and 11, the diffusion exhaust pipe 13 and the compression exhaust pipe 14 may be provided in a state where they are not connected inside the cover body 11. In this case, lengths of the diffusion exhaust pipe 13 and the compression exhaust pipe 14 may be adjusted arbitrarily.

Figure 2:
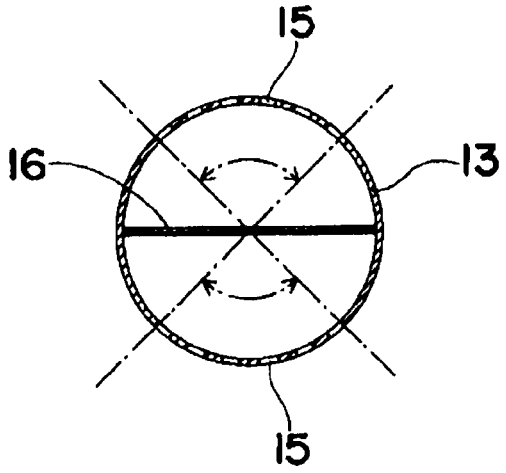
FIG. 2 is a cross-sectional view illustrating a diffusion exhaust pipe of the first embodiment.

When the internal exhaust pipe 12 is connected in a series shape, a partition plate 16, which bisects the inside of the diffusion exhaust pipe 13 and the compression exhaust pipe 14, respectively, is disposed along the longitudinal direction thereof (see, FIG. 2). In the illustrated example, the diffusion pore 15 is drilled on the diffusion exhaust pipe 13 and the diffusion pore 15 is not drilled on the compression exhaust pipe 14; however, the pore similar to the diffusion pore 15 may be drilled on the compression exhaust pipe 14 (not illustrated). In this case, the exhaust gas diffused inside the chamber 10 is compressed again and is introduced from the pore of the compression exhaust pipe 14 into the compression exhaust pipe 14.

In addition, in FIG. 4, when the diffusion exhaust pipe 13 and the compression exhaust pipe 14 are connected in parallel with each other, an open end portion of the inside of the cover body 11 is closed and they communicate with each other through the connection pipe 17 via the side surface of the internal exhaust pipe 12.

The tail pipe 20 of the present invention is configured such that the fins 21 are disposed inside a cylindrical member formed from an appropriate metal material such as stainless steel or an appropriate composite material. The tail pipe 20 in the example illustrated in the figure further has a cover body 22 thereby having an excellent exterior. The cover body 22 is formed from an appropriate metal material (for example, stainless steel); an appropriate reinforced resin material, an appropriate composite material or the like and then an appropriate decoration may be applied to the outer surface thereof In addition, the tail pipe 20 which does not have the cover body 22 can be used.

On the other hand, the fin 21 is a member disposed the inner peripheral surface of the tail pipe 20 and is formed from an appropriate metal material (for example, stainless steel), an appropriate reinforced resin material, an appropriate composite material or the like, and exhibits a substantially band plate shape. Then, a plurality (for example, six, eight, twelve or the like) of the fins 21 are disposed in a spiral shape which is gradually widened toward a direction of discharging the exhaust gas.

Then, the exhaust gas passing through inside the tail pipe 20 is guided to the fins 21 and is rotated in a substantially spiral shape, and is discharged to the atmosphere while being diffused. At this time, the pressure of the exhaust gas passing through the center portion of the fin 21 is decreased so that exhaust action is promoted and exhaust resistance inside the exhaust muffler 2 is reduced.

Figure 3:
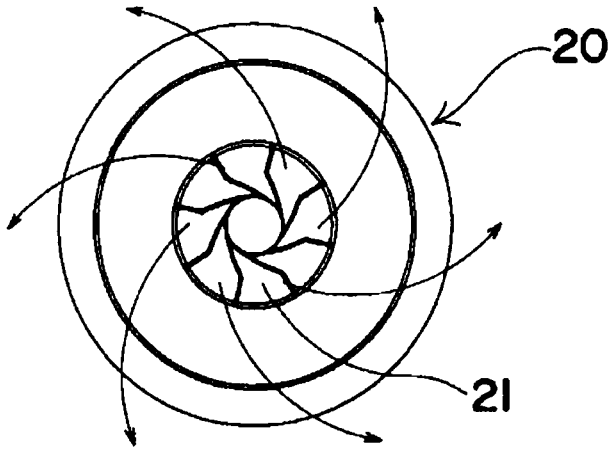
FIG. 3 is a front view illustrating a tail pipe of the first embodiment.
Figure 6:
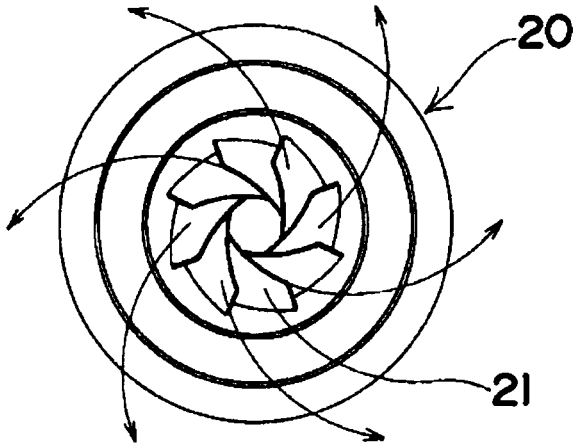
FIG. 6 is a front view illustrating the tail pipe illustrated in FIG. 4.

The shape of the tail pipe 20 may be selected from a cylindrical shape, a taper shape and a reverse taper shape. In other words, the cylindrical shape of the tail pipe 20 has the same diameter extending from the end portion of the exhaust pipe 1 in the discharging direction of the exhaust gas (see, FIGS. 1 and 3). In addition, the taper shape has a diameter which is widened as extending in the discharging direction of the exhaust gas (see, FIGS. 4 and 6). Furthermore, the reverse taper shape has a diameter which narrows in the discharging direction of the exhaust gas (see, FIGS. 7 and 8).

First Embodiment

FIGS. 1 and 2 illustrate an embodiment in which the diffusion exhaust pipe 13 and the compression exhaust pipe 14 are connected in series with each other inside the chamber 10 (see, FIG. 1). The partition plate 16, which bisects the inside of the diffusion exhaust pipe 13 in the longitudinal direction and the compression exhaust pipe 14, respectively, is formed (see, FIG. 2). Then, the diffusion pores 15 are drilled so as to be distributed in the symmetrical positions through the partition plate 16 of the peripheral surface of the diffusion exhaust pipe 13. The diffusion pores 15 are provided along the longitudinal direction thereof in a range of 50% of the periphery of the diffusion exhaust pipe 13 (see, FIG. 2).

The tail pipe 20 is formed in the cylindrical shape having the proximately same diameter extending from the end portion of the exhaust pipe 1 in the discharging direction of the exhaust gas. Eight fins 21 are disposed in the spiral shape which is widened gradually toward the discharging direction of the exhaust gas inside the tail pipe 20 (see, FIG. 3).

Figure 12:
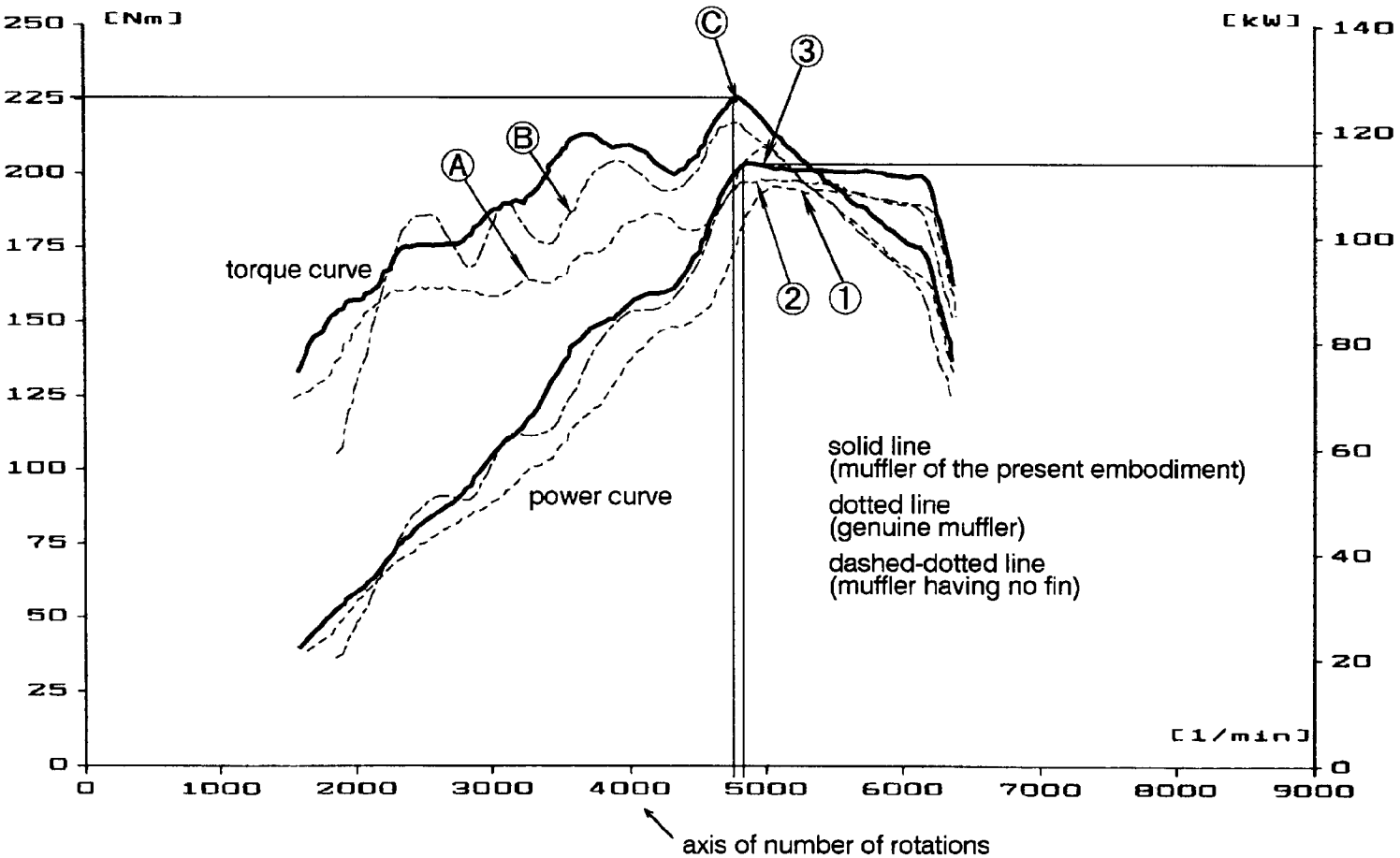
FIG. 12 shows Table 1 which illustrates comparison of power data and torque data obtained by a test.

Table 1 (see, FIG. 12) illustrates comparison of power data and torque data obtained by a test. In the test, data have been compared among a genuine muffler, the muffler of the present invention and the exhaust muffler using only the chamber 10 of the present invention, which have been installed on test vehicles (VOXY manufactured by Toyota) on which an engine of 2000 cc is mounted. A chassis dynamometer (Bosch FLA206 (Registered trademark)) has been used as the instrument device.

In Table 1, marks (a circle 1) to (a circle 3) illustrate the power data, the mark (the circle 1) is the genuine muffler, the mark (the circle 2) is the exhaust muffler of only the chamber 10 and the mark (the circle 3) is the muffler of the present invention illustrated in FIG. 1.

On the other hand, marks (a circle A) to (a circle C) illustrate the torque data, the mark (the circle A) is the genuine muffler, the mark (a circle B) is the exhaust muffler of only the chamber 10 and the mark (the circle C) is the muffler of the present invention illustrated in FIG. 1.

As is clear in Table 1, superiority of the power (the circle 3) of the muffler of the present invention has been observed clearly compared to the genuine muffler (the circle 1).

On the other hand, superiority of the torque (the circle C) of the muffler of the present invention has been observed clearly compared to the genuine muffler (the circle A). Furthermore, as illustrated in (the circle 2) and (the circle B), in the exhaust muffler using only the chamber 10, sufficient effect cannot be exhibited in both of the power and the torque compared to the muffler (the circle 3) and (the circle C) of the present invention.

TABLE 2

| | comparison of power data | | | | |
|---|---|---|---|---|---|
| specification | display section | kw | ps conversion value | rpm | compared to genuine muffler (ps) |
| genuine muffler | Table 1 (1) | 109.5 | 148.9 | 5060 | reference value |
| muffler having no fin | Table 1 (2) | 111.3 | 151.4 | 5020 | +2.4 |
| muffler of the present invention | Table 1 (3) | 113.9 | 154.9 | 4860 | +6.0 |

| | comparison of torque data | | | | compared to |
|---|---|---|---|---|---|
| specification | display section | Nm | kg-m conversion value | rpm | genuine muffler (kg/m) |
| genuine muffler | Table 1 (A) | 208.9 | 21.3 | 4940 | reference value |
| muffler having no fin | Table 1 (B) | 217.8 | 22.2 | 4770 | +0.9 |
| muffler of the present invention | Table 1 (C) | 225.2 | 23.0 | 4790 | +1.7 |

Table 2 illustrates specific numerical values of Table 1. In other words, the power (the circle 3) when the muffler of the present invention was used is 154.9 ps and improvement of the engine power has been observed by +6.0 ps compared to 148.9 ps of the power (the circle 1) when the genuine muffler was used. In addition, also improvement of +2.4 ps has been detected in the exhaust muffler (the circle 2) using only the chamber 10 compared to the genuine muffler.

In addition, also in the engine torque, the present invention (the circle C) has been 23.0 kg/m while the genuine muffler (the circle 1) has been 21.3 kg/m. Accordingly, the torque has been increased by +1.7 kg/m, practically. Furthermore, the exhaust muffler (the circle B) using only the chamber 10 has been 22.2 kg/m and the torque has been increased by +0.9 Kg/m.

TABLE 3

| installed muffler | running distance (km) | a fuel supply amount (l) | fuel consumption (km/l) | normal comparison rate up or down | |
|---|---|---|---|---|---|
| genuine muffler | 154.7 | 12.39 | 12.5 | reference value | |
| muffler having no fin | 155 | 12.23 | 12.7 | 1.5% | ↑up |
| muffler of the present invention | 154.8 | 11.01 | 14.1 | 12.6% | ↑up |

Table 3 illustrates fuel consumption data in the same course after the test vehicles (VOXY manufactured by Toyota) practically run, on which the genuine muffler, the exhaust muffler (the muffler having no fins) using only the chamber 10 and the muffler of the present invention illustrated in the first embodiment, are mounted. The test data are detection data obtained from a total 3,100 km of a total 20 times in the running test.

The test regarding the fuel consumption is commonly referred to as a full tank. In addition, the vehicles repeatedly run the same course under the same condition and the fuel consumption is calculated by the running distance and a fuel supply amount at the time. Record of the fuel supply amount has been performed by an automatic stop method in a fuel dispenser and the fuel supply amount is recorded under the same condition. The running distance employs the record of the odometer mounted on the vehicle and the distance from the reset when supplying the fuel to the next supply of the fuel has been recorded. The fuel consumption (Km/l) is the running distance (km) the fuel supply amount (1).

As illustrated in Table 3, the test result is that the fuel consumption when the present invention has been used is 14.1 (Km/l) and the improvement of +12.6% of the fuel consumption has been observed compared to the fuel consumption of 12.5 (Km/l) when the genuine muffler has been used. In addition, the improvement of +1.5% has been observed in the type in which the tail pipe 20 is not connected.

Second Embodiment

Figure 5:
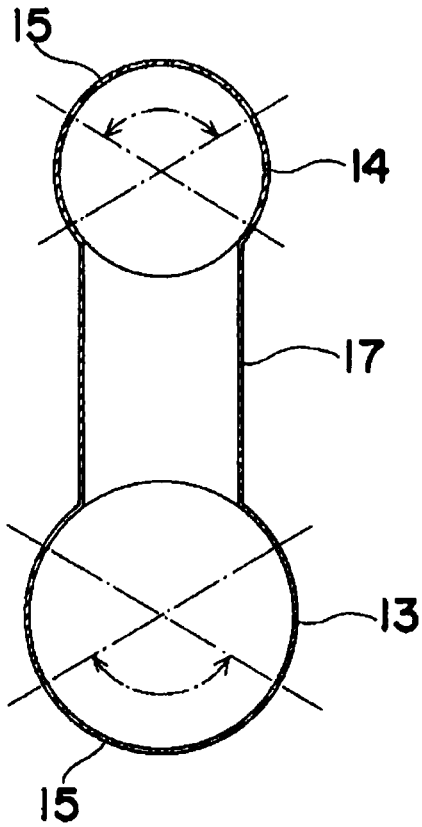
FIG. 5 is a cross-sectional view which is taken along an arrow line V-V illustrated in FIG. 4.

FIGS. 4 and 5 illustrate a second embodiment of the present invention. The chamber 10 is configured such that the diffusion exhaust pipe 13 and the compression exhaust pipe 14 are connected in parallel with each other inside the cover body 11 (see, FIG. 4). In the example illustrated in the view, the side surfaces of the diffusion exhaust pipe 13 and the compression exhaust pipe 14 are connected to each other through two connection pipes 17. In addition, the diffusion pores 15 are drilled on the side surfaces of the diffusion exhaust pipe 13 and the compression exhaust pipe 14. In other words, the diffusion pores 15 are drilled on the side surfaces which are in the farthest positions between the diffusion exhaust pipe 13 and the compression exhaust pipe 14. The diffusion pores 15 of the embodiment are provided along the longitudinal direction thereof in a range of 30% of the periphery of the diffusion exhaust pipe 13 and the 30% of the periphery of the compression exhaust pipe 14 (see, FIG. 5).

Figure 13:
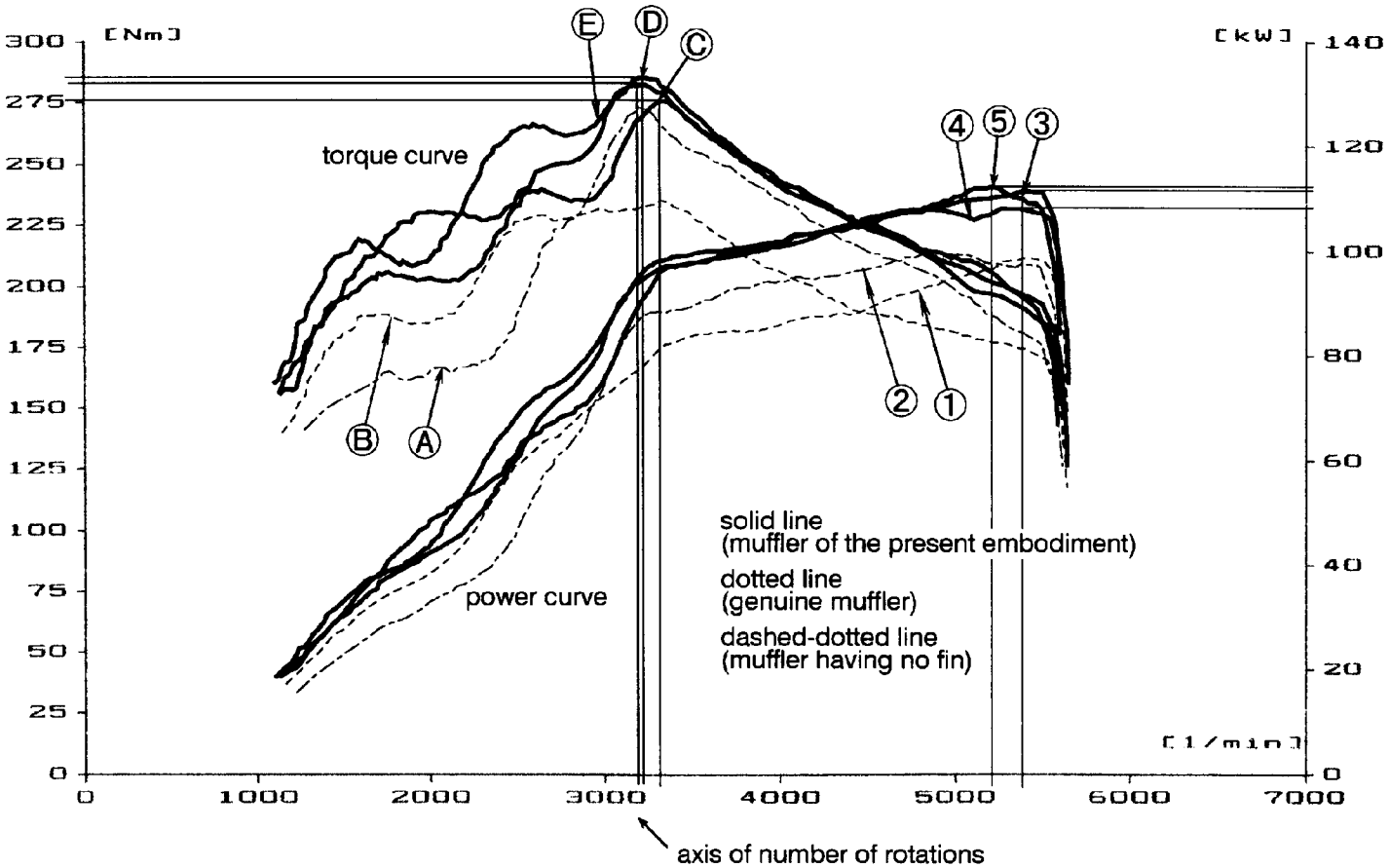
FIG. 13 shows Table 4 which illustrates comparison of power data and torque data obtained by a test.

Table 4 (see, FIG. 13) illustrates comparison of power data and torque data obtained by a test. In the test, data have been compared, the data having been obtained by installing a genuine muffler, the exhaust muffler of the present invention, or the exhaust muffler using only the chamber 10 of the present invention on test vehicles (PRIUS manufactured by Toyota). The chassis dynamometer (Bosch FLA206 (Registered trademark)) has been used as the instrument device.

Figure 7:
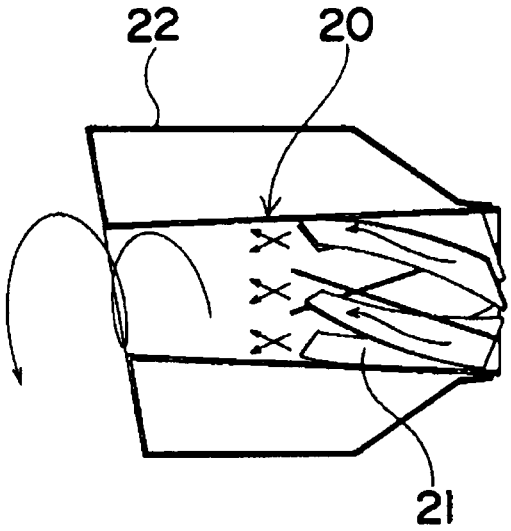
FIG. 7 is a side cross-sectional view illustrating another embodiment of the tail pipe of the present invention.
Figure 8:
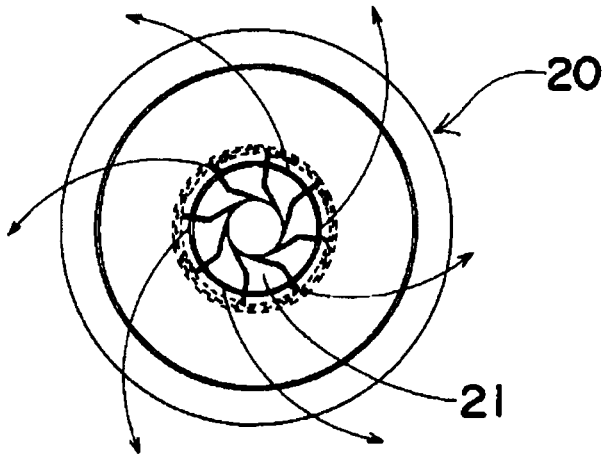
FIG. 8 is a front view of the tail pipe illustrated in FIG. 7.
Figure 9:
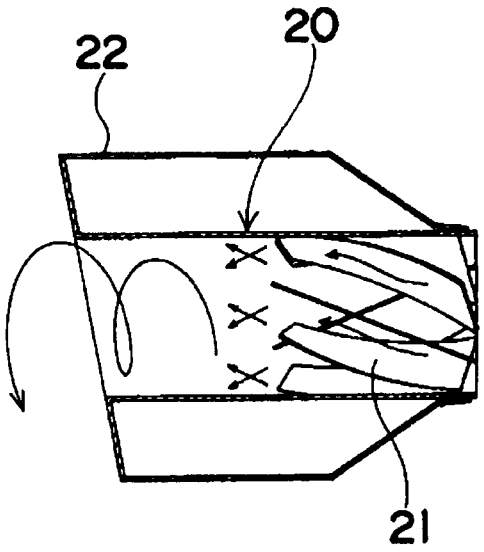
FIG. 9 is a front view of a cylindrical tail pipe.

In Table 4, marks (a circle 1) to (a circle 5) illustrate the power data, the mark (the circle 1) is the genuine muffler, the mark (the circle 2) is the exhaust muffler using only the chamber 10 and the mark (the circle 3) is the muffler of the present invention illustrated in FIG. 4. Furthermore, the mark (the circle 4) is the muffler of the present invention in which the cylindrical tail pipe 20 illustrated in FIG. 9 is combined and the mark (the circle 5) is a muffler of the present invention in which the reverse taper-shaped tail pipe 20 illustrated in FIG. 7 is combined.

On the other hand, marks (a circle A) to (a circle E) illustrate the torque data, the mark (the circle A) is the genuine muffler, the mark (the circle B) is the exhaust muffler using only the chamber 10 and the mark (the circle C) is the muffler of the present invention illustrated in FIG. 4. Furthermore, the mark (the circle D) is the muffler of the present invention in which the cylindrical tail pipe 20 illustrated in FIG. 9 is combined and the mark (the circle E) is a muffler of the present invention in which the reverse taper-shaped tail pipe 20 illustrated in FIG. 7 is combined. In addition, the chassis dynamometer (Bosch FLA206 (Registered trademark)) has been used as the instrument device.

As clear in Table 4, superiority of the power (the circle 3) to (the circle 5) of the present invention has been observed clearly compared to the genuine muffler (the circle 1). In addition, superiority of the torque (the circle C) to (the circle E) of the present invention has been observed clearly compared to the genuine muffler (the circle A). Furthermore, as illustrated in (the circle 2) and (the circle B), when the tail pipe 20 is not connected, sufficient effect cannot be exhibited in both of the power and the torque.

In addition, that specific characteristics are held, respectively, by changing the shape of the tail pipe 20 while the high performances thereof are maintained has been observed clearly. Accordingly, higher superiority is obtained by combining the shapes of the tail pipe 20 depending on the engine type or the displacement.

TABLE 5

| | comparison of power data | | | | |
|---|---|---|---|---|---|
| specification | display section | kw | ps conversion value | rpm | compared to genuine muffler (ps) |
| genuine muffler | Table 4 (1) | 98.8 | 134.4 | 5430 | reference value |
| muffler having no fin | Table 4 (2) | 99.4 | 135.2 | 4900 | +0.8 |
| taper-type muffler of the present invention | Table 4 (3) | 111.3 | 151.4 | 5380 | +17.0 |
| cylindrical muffler of the present invention | Table 4 (4) | 107.9 | 146.7 | 5280 | +12.4 |
| reverse taper-type muffler of the present invention | Table 4 (5) | 111.8 | 152.0 | 5200 | +17.7 |

| | comparison of torque data | | | | compared to |
|---|---|---|---|---|---|
| specification | display section | Nm | kg-m conversion value | rpm | genuine muffler (kg/m) |
| genuine muffler | Table 4 (A) | 235 | 24.0 | 3340 | reference value |
| muffler having no fin | Table 4 (B) | 273.5 | 27.9 | 3200 | +3.9 |
| taper-type muffler of the present invention | Table 4 (C) | 276.4 | 28.2 | 3310 | +4.2 |
| cylindrical muffler of the present invention | Table 4 (D) | 285.3 | 29.1 | 3200 | +5.1 |
| reverse taper-type muffler of the present invention | Table 4 (E) | 282.2 | 28.8 | 3340 | +4.8 |

Table 5 illustrates specific numerical values in FIG. 4. In other words, the power of (the circle 3), (the circle 4), and (the circle 5) when the muffler of the present invention was used is 151.4 ps, 146.7 ps and 152.0 ps, respectively, and improvement of all the powers have been observed by +17.0 ps, +12.4 ps and +17.7 ps compared to 134.4 ps of the power when the genuine muffler was used. In addition, also improvement of +0.8 ps has been detected in the exhaust muffler (the circle 2) using only the chamber 10 compared to the genuine muffler.

In addition, also in the engine torque, the present invention (the circle C), (the circle D) and (the circle E) have been 28.2 kg/m, 29.1 kg/m and 28.8 kg/m, respectively while the genuine muffler (the circle A) has been 24.0 kg/m. Accordingly, the astonishing improvements of +4.2 kg/m, +5.1 kg/m, and +4.8 kg/m have been observed. Furthermore, the exhaust muffler using only the chamber 10 has been 27.9 kg/m and the torque has been increased by +3.9 Kg/m compared to the genuine muffler.

TABLE 6

| installed muffler | running distance (km) | a fuel supply amount (l) | fuel consumption (km/l) | normal comparison rate up or down | |
|---|---|---|---|---|---|
| genuine muffler (1) | 154.1 | 6.43 | 24.0 | reference value | |
| muffler having no fin (2) | 154 | 6.35 | 24.3 | 1.2% | ↑up |
| taper-type muffler of the present invention (3) | 154 | 5.98 | 25.8 | 7.5% | ↑up |
| cylindrical muffler of the present invention (4) | 154 | 5.72 | 26.9 | 12.3% | ↑up |
| reverse taper-type muffler of the present invention (5) | 155.1 | 5.44 | 28.5 | 19.0% | ↑up |

Table 6 illustrates fuel consumption data in the same course after the test vehicles (PURIUS manufactured by Toyota) practically run, on which the genuine muffler, the exhaust muffler (the muffler having no fins) using only the chamber 10 and the muffler of the present invention illustrated in the second embodiment are mounted. The data are data detected in actual running on a total 4,650 km of a total 30 times in the running test. The test which detects the fuel consumption data is performed by the above described full tank.

As a result of the test, the fuel consumptions when the mufflers (the circle 3), (the circle 4), and (the circle 5) of the present invention has been used have been 25.8 (Km/l), 26.9 (km/l), and 28.5 (km/l), respectively, and the improvement of +7.5%, +12.3%, and +19.0% in the fuel consumption has been observed compared to the fuel consumption of 24.0 (Km/l) when the genuine muffler (the circle 1) has been used, respectively. In addition, the improvement of +1.2% has been observed in the exhaust muffler (the circle 2) using only the chamber 10 compared to the genuine muffler.

INDUSTRIAL APPLICABILITY

The exhaust muffler of the present invention can be used as exhaust mufflers of various types of vehicles. In addition, the specific configuration, the shape, the dimensions and the material of the chamber 10 or the tail pipe 20, the specific means for mounting to the exhaust muffler, the specific configuration, the shape, the dimensions, the material, the number, the installation position and the twisted state of the fins 21 or the like of the present invention is not limited to the examples illustrated in the drawings and the design thereof may be changed appropriately and freely.

DESCRIPTION OF THE REFERENCE SYMBOLS

| | |
|---|---|
| 1 | exhaust pipe |
| 2 | exhaust muffler |
| 10 | chamber |
| 11 | cover body |
| 12 | internal exhaust pipe |
| 13 | diffusion exhaust pipe |
| 14 | compression exhaust pipe |
| 15 | diffusion pore |
| 16 | partition plate |
| 17 | connection pipe |
| 20 | tail pipe |
| 21 | fin |
| 22 | cover body |

The invention claimed is:

1. An exhaust muffler including a tail pipe comprising:

a chamber provided in the middle of an exhaust pipe for an internal combustion engine; and a tail pipe which is connected to an end portion of an exhaust opening of the exhaust pipe and in which a plurality of fins are disposed inside thereof so as to form a spiral shape toward a discharging direction of exhaust gas, wherein:

the chamber comprises a cover body surrounding a periphery is a side surface of the exhaust pipe and an internal exhaust pipe in which a plurality of diffusion pores are drilled on the side surface of the exhaust pipe surrounded by the cover body;

the internal exhaust pipe comprises a diffusion exhaust pipe having a wide bore, which is provided on an inlet side of the exhaust gas and a compression exhaust pipe having a narrow bore, which is provided on an outlet side of the exhaust gas;

the diffusion pores are drilled on a portion of the side surface of the internal exhaust pipe in the chamber, the diffusion exhaust pipe and the compression exhaust pipe are connected in series with each other, and a partition plate bisecting the inside of the diffusion exhaust pipe and the compression exhaust pipe in the longitudinal direction is formed; and the diffusion pores are drilled to be distributed on symmetrical positions in a range of 30to 60% of the periphery of the internal exhaust pipe through the partition plate of the peripheral surface of the diffusion exhaust pipe.

2. The exhaust muffler provided with a tail pipe according to claim 1, wherein the tail pipe is formed in a cylindrical shape having the same diameter extending from the end portion of the exhaust pipe to the discharging direction of the exhaust gas, a taper shape having a diameter which is widened as extending in the discharging direction of the exhaust gas, or a reverse taper shape having a diameter which is narrowed as extending in the discharging direction of the exhaust gas.

* * * * *